US005810052A

United States Patent [19]

Kozyuk

[11] Patent Number: 5,810,052

[45] Date of Patent: Sep. 22, 1998

[54] METHOD OF OBTAINING A FREE DISPERSE SYSTEM IN LIQUID AND DEVICE FOR EFFECTING THE SAME

[75] Inventor: Oleg Vyacheslavovich Kozyuk, Cleveland, Ohio

[73] Assignee: Five Star Technologies Ltd., Cleveland, Ohio

[21] Appl. No.: 887,721

[22] Filed: Jul. 7, 1997

Related U.S. Application Data

[63] Continuation of Ser. No. 602,069, Feb. 15, 1996, abandoned.

[51] Int. Cl.[6] ..... F15D 55/00

[52] U.S. Cl. ..... 138/37; 138/40; 138/44; 366/336; 366/337; 366/338

[58] Field of Search ..... 138/37, 44, 40, 138/42; 366/336, 337, 338; 73/861.52

[56] References Cited

U.S. PATENT DOCUMENTS

| | | | |
|---|---|---|---|
| 513,318 | 1/1894 | Grimm | 138/44 X |
| 830,338 | 9/1906 | Ledoux | 138/44 X |
| 1,627,161 | 5/1927 | Edwards | 138/44 X |
| 1,892,906 | 1/1933 | Schnitter | 138/44 |
| 4,316,673 | 2/1982 | Speer | 336/337 |
| 4,344,752 | 8/1982 | Gallagher, Jr. | 336/336 X |
| 4,915,135 | 4/1990 | Kellenbarger et al. | 138/44 |
| 5,085,058 | 2/1992 | Aaron et al. | 138/44 X |
| 5,145,256 | 9/1992 | Wiemers et al. | 366/337 X |
| 5,341,848 | 8/1994 | Laws | 138/44 |
| 5,413,145 | 5/1995 | Rhyne et al. | 138/44 |
| 5,492,654 | 2/1996 | Kozjuk et al. | 366/336 X |
| 5,495,872 | 3/1996 | Gallagher et al. | 138/44 |

*Primary Examiner*—Patrick F. Brinson
*Attorney, Agent, or Firm*—Emerson & Associates; Roger D. Emerson; Mark E. Duell

[57] ABSTRACT

A method of obtaining a free disperse system in liquid which produces a controlled hydrodynamic cavitation by regulation of constriction ratio, volumetric flow rate, and degree of cavitation parameters. Selection of the parameters with regard to the properties of components of the fluid make it possible to effectively treat the components having a variety of physio-chemical characteristics. The invention further relates to the construction of a cavitation device wherein the geometry of a flow-constricting baffle body effectively increases the degree of cavitation to substantially improve the quality of an obtained free disperse system.

32 Claims, 2 Drawing Sheets

METHOD OF OBTAINING A FREE DISPERSE SYSTEM IN LIQUID AND DEVICE FOR EFFECTING THE SAME

This application is a continuation of application Ser. No. 08/602,069 filed Feb. 15, 1996 now abandoned.

BACKGROUND OF THE INVENTION

1. Field of Invention

The present invention relates to a method of obtaining a free disperse system in liquid which will make it possible to produce a controlled hydrodynamic cavitation and to regulate the intensity parameters of a hydrodynamic cavitation field. Selection of the parameters with regard to the properties of components of the fluid under treatment which in turn will make it possible to effectively treat the components with different physio-chemical characteristics. The invention particularly relates to a cavitation device for effecting this method with a baffle body of such a construction which will allow the multiplicity of treatment to be regulated along with an increase in degree of cavitation which will substantially improve the quality of an obtained free disperse system and will substantially extend technological capabilities of the method.

2. Description of the Related Art

Widely known in the prior art are methods of obtaining free disperse systems and particularly lyosols, diluted suspensions and emulsions, using the effect of cavitation.

These systems are fluidic and particles of a dispersed phase have no contacts, participate in a random beat motion and freely move by gravity. In these methods, the emulsification and dispersion processes are accomplished due to cavitation effects expediently set up in the flow under treatment by hydrodynamic means at the expense of a sharp change in geometry of the flow.

Also known in the prior art are devices for effecting these methods of which the basic element is presented by a baffle body installed in a flow channel in the direction of a hydrodynamic flow.

Phenomenon of the hydrodynamic cavitation resides in the formation of cavities filled with a vapor-gas mixture inside the liquid flow or at the boundary of the baffle body due to a local pressure drop caused by movement of the fluid. Mixing, emulsification homogenization and dispersion effects of the hydrodynamic cavitation result from a substantial plurality of force effects on the treated mixture of components due to the collapse of cavitation bubbles. The collapse of cavitation bubbles near the boundary of "liquid-solid particles" phases results in dispersion of these particles in the fluid and in formation of the suspension, while in the "liquid-liquid" system one fluid is atomized in the other fluid and results in formation of the emulsion. In both cases, the boundary of solid phases is destroyed, i.e. eroded, and a dispersive medium and a dispersed phase are formed.

For the most part, the models explaining the mechanism of emulsification and dispersion processes accomplished by means of cavitation are based at the present time on the use of a cumulative hypothesis of the cavitation effect on a surface to be destroyed. The process of dispersion by means of cavitation is associated with the formation of cumulative microjets. It is supposed, that due to the interaction of a shock wave set up by the collapse of cavitation bubbles with the bubbles arranged at the boundary of the phases, the cumulative microjets are formed. Intensive mixing and dispersion is explained by the formation of high-intensity microvortices and by a sequential disintegration of the cumulative microjets. The process of the fluid atomization is caused by tangential stresses acting on the referred fluid and occurring at the boundaries of cavitation microvortices, while the dispersion of solid particles is accomplished due to a hydrodynamic penetration of a cumulative microjet into a particle.

In addition to erosion effects caused by the collapse of cavitation bubbles, other physio-chemical effects occur serving as additional factors in the intensification of technological processes.

It should also be noted that physical characteristics of the mixture of components in the flow under treatment have a substantial influence on the erosion activity of cavitation bubbles. For example, increase of viscosity, decrease of surface tension and density of the fluid, as well as increase of the gas content therein reduce the efficiency of the cavitation effect.

There is also known, a method of obtaining a free disperse system, i.e. a suspension of fibrous materials, involving the passage of a hydrodynamic flow of fibrous materials through a channel internally accommodating a baffle body installed across the flow for providing a local contraction of the flow and forming downstream of the referred body a hydrodynamic cavitation field acting on the flow of fibrous materials until the suspension of the referred materials is formed.

An attempt was made for effecting the method described hereinabove, in which a device was proposed consisting of a housing with inlet and outlet openings, a contractor, an internal flow channel accommodating a solid cylindrical baffle body and a diffuser (U.S. Pat. No. 3,834,982) arranged in succession on the inlet opening side and connected together.

It must be emphasized that there are fundamental differences between the Cavitation Method and Device described and claimed in the present Patent Application and the other prior art devices such as static mixers. The static mixers of the prior art references (i.e. Durrieu et al, U.S. Pat. No. 4,464,057, Wiemers et al, U.S. Pat. No. 5,145,256 and Japanese patent 45 - 40634) rely on turbulence or high Reynolds Numbers to produce their desired result. They may experience cavitation during their operation but such cavitation is incidental to their operation. The claimed Cavitation Device differs fundamentally from prior art devices due to the fact that controlled cavitation is a fundamental requirement and an achieved accomplishment for the successful operation of the claimed invention.

The shape of the internal baffle body used in the claimed Cavitation Device is different from conventional devices due to the fact that it is designed specifically to produce controlled cavitation. Mixing and homogenization processes in the claimed Cavitation Device are based on using hydrodynamic cavitation connected with physical and mechanical effects (including but not limited to shock waves, cumulative effects of bubble collapse, self-excited oscillations, vibroturbolization, and straightened diffusion) occurring at a collapse of cavitation bubbles.

SUMMARY OF THE INVENTION

The invention is essentially aimed at providing a method of obtaining a free disperse system in liquid which will make it possible to regulate the intensity of a hydrodynamic cavitation field and to select its parameters with due regard to properties of components of the flow under treatment. This in turn will make it possible to effectively treat the components with different physio-chemical characteristics and to develop a device for effecting this method with a baffle body of such a design which will allow the multiplicity of treatment to be regulated along with increasing the degree of cavitation which will substantially improve the quality of an obtained free disperse system in liquid and will substantially extend technological capabilities of the method.

This is attained by, that in a method of obtaining a free disperse system in liquid involving the passage of a hydrodynamic flow of components through a channel internally accommodating a baffle body providing a local constriction of the flow, a hydrodynamic cavitation field is formed downstream of this body which affects the flow of components under treatment and forms a flow of the free disperse system. According to the invention, the local constriction of the flow is accomplished in at least one section of the flow channel emanating from the condition of maintaining the ratio of the cross-sectional portion of the hydrodynamic flow in the local constriction to the cross-sectional portion of the flow in the flow channel to 0.8 or less, maintaining the velocity of the hydrodynamic flow of components in the local constriction to at least 14 meters/seconds which provides for the development of a hydrodynamic cavitation field downstream from the baffle body having a degree of cavitation of at least 0.1, and, processing the flow of components mixture in the hydrodynamic cavitation field downstream from the baffle body. Furthermore, the local flow constriction of the components mixture created on the periphery of the flow, its path accommodated by the baffle body, is established at or near to the center of the flow-through passage, as well as, the local flow constriction of the components mixture created in or near the center of the flow, its path accommodated by the baffle body, is established near the walls of the flow-through passage, are in both cases, according to the invention, are feasible and conditional for the method of obtaining a free disperse system in liquid. Although the invention is described herein in terms of constriction, the terms "impingement" or "contraction" of the flow are equally applicable.

Such a method makes it possible to obtain high-quality aggregate-stable lyosols, emulsions and suspensions from components, having different physio-chemical characteristics, at the expense of a more complete utilization of erosion activity of the field of cavitation microbubbles and energy of the flow of components under treatment.

Maintenance of the above-mentioned values of the referred parameters (velocity and degree of cavitation) is an indispensable condition for setting up and developing the hydrodynamic cavitation under the referred conditions.

The ratio of the cross-sectional portion of the hydrodynamic flow in the local constriction to the cross-sectional portion of the flow in the flow channel to 0.8 or less is an important condition to maintain.

With such a ratio of the cross-sectional portion of the flow in the local constriction and flow channel and due to the set-up of hydrodynamic effects, shock waves are formed and intensively affect the cavitation field of bubbles which collapse and form cumulative jets. Due to this fact, conditions are set up for coordinated collapse of groups of cavitation bubbles in a local volume along with the formation of high-energy three-dimensional shock waves whose propagation intensifies the disintegration of cavities and collapse of groups of cavitation bubbles, found in the process of collapse. In the case of a coordinated collapse of cavitation bubbles having the same characteristic dimensions, the intensity and energy potential of the cavitation field is approximately one order of magnitude higher than at a single non-coordinated collapse of bubbles.

Thus, the energy is concentrated and the erosion effect is enhanced on the flow of components under treatment. Secondary shock waves formed as a result of impacts of microjets on the walls of cavitation bubbles during their interaction are also intensively affecting this flow. All of this provides conditions for initiation of vibro-turbulent effects due to which the components are intensively mixed and redistributed in the local volume of the flow channel, and subjected to additional treatment. Furthermore, the effects described hereinabove facilitate disintegration of the cavities formed downstream of the baffle body into a more homogenous field of relatively small cavitation bubbles, thereby causing a high efficiency of their coordinated collapse. In addition, using the ratio of the cross-sectional portion, the hydrodynamic flow in the local constriction and flow channel of 0.8 or less, allows to exclude the possibility of the processing flow slipping through and past the field of collapsing cavitation bubbles.

The method, according to the invention, makes it possible to regulate the intensity of an occurring hydrodynamic cavitation field as applied to specific technological processes.

Still other benefits and advantages of the invention will become apparent to those skilled in the art to which it pertains upon a reading and understanding of the following detailed specification.

BRIEF DESCRIPTION OF THE DRAWINGS

Some specific examples of embodiments are presented of the herein—proposed method of obtaining a free disperse system in liquid, according to the invention, presented with reference to the accompanying drawings, wherein.

DESCRIPTION OF THE PREFERRED EMBODIMENT

The method, according to the invention, consists of feeding a hydrodynamic flow of a mixture of liquid components via a flow-through passage, wherein a baffle body is placed, with the baffle body having such a shape and being so arranged that the flow of liquid components is constricted on at least one portion thereof. The cross-sectional profile design of the flow constriction area is selected so as to maintain such a flow velocity that provides for the creation of a hydrodynamic cavitation field past the baffle body. The flow velocity in a local constriction is increased while the pressure is decreased, but not less than 14 meters/second, with the result that the cavitation cavities or voids are formed in the flow past the baffle body, which on having been disintegrated, form cavitation bubbles which determine the structure of the cavitation field.

The cavitation bubbles enter into the increased pressure zone resulting from a reduced flow velocity, and collapse. The resulting cavitation effects exert a physio-chemical effect on the mixture of liquid components, thus initiating improved mixing, emulsification, homogenization, dispersion.

In order to utilize the energy generated in the cavitation field to the best advantage, the degree of cavitation of the cavitation field must not be below 0.1.

The ratio of the cross-sectional portion of the hydrodynamic flow in the local constriction to the cross-sectional portion of the flow in the flow channel to 0.8 or less, preferably between 0.5 and 0.8, is an important condition to maintain.

Figure 1:
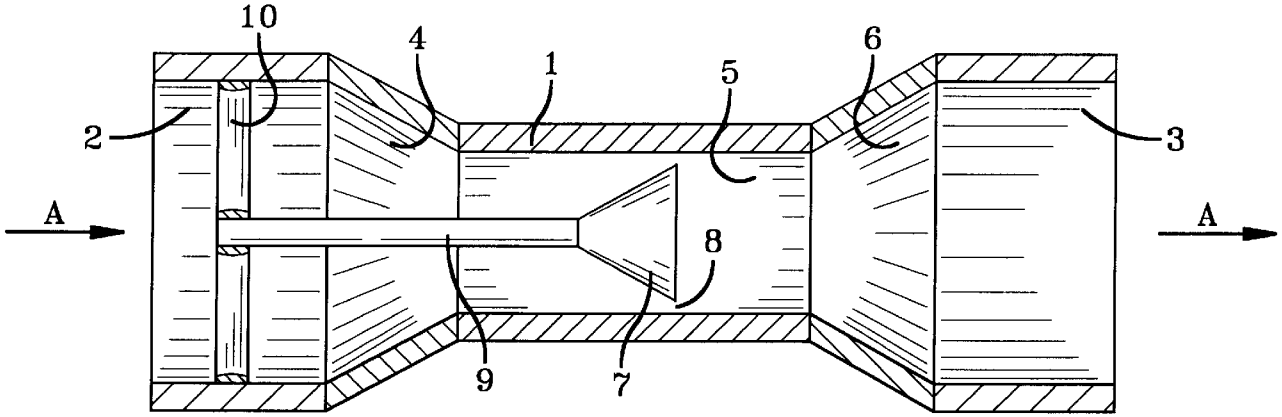
FIG. 1 is a schematic of a longitudinal section view of a device for carrying out the herein—proposed method into effect, featuring a cone-shaped baffle body.
Figure 2:
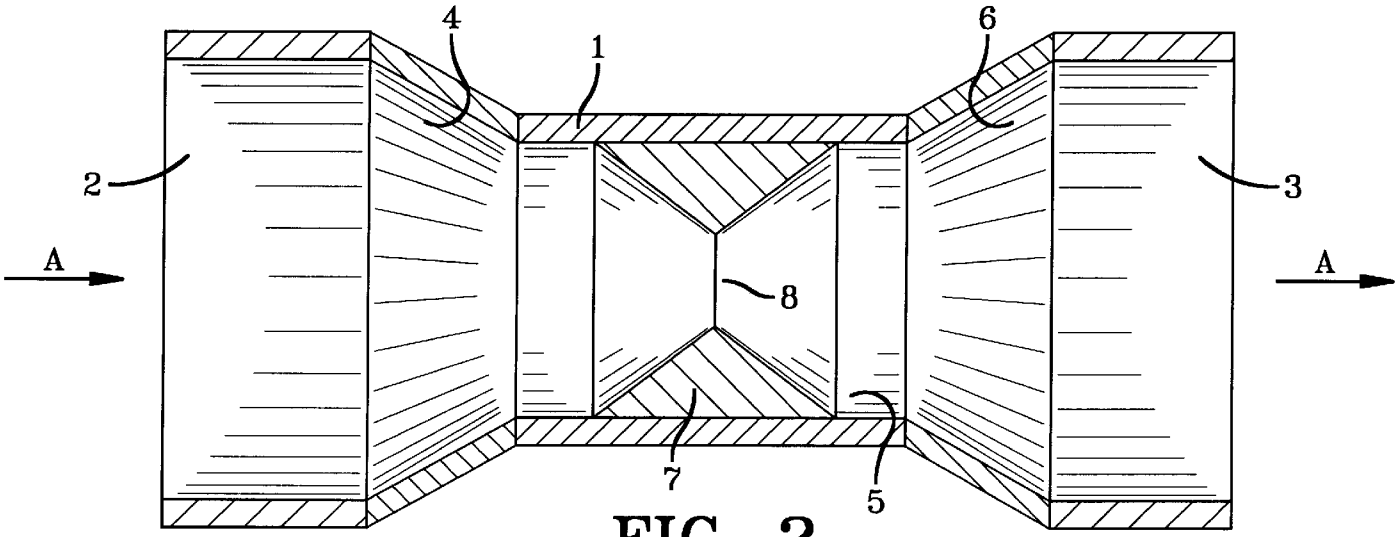
FIG. 2 is a longitudinal section view of another embodiment of a device for carrying out the herein—proposed method into effect, featuring a flow-throttling baffle body shaped as the Venturi tube.

A device schematically presented in FIGS. 1 and 2 is used for carrying into effect the method, according to the invention.

Reference is now being directed to the accompanying Drawings:

FIG. 1 presents the device, comprising a housing 1 having an inlet opening 2 and an outlet opening 3, and arranged one after another and connecting to one another a convergent nozzle 4, a flow-through passage 5, and a divergent nozzle 6.

The flow-through passage 5 accommodates a frustum-conical baffle body 7 which establishes a local flow constriction 8 having an annular cross-sectional profile design. The baffle body 7 is held to a rod 9 coaxially with the flow-through passage 5. Rod 9, for example, is attached to stud 10, mounted to divergent 6 near inlet 2.

The hydrodynamic flow of a mixture of liquid components moves along the arrow A through the inlet opening 2 and the convergent nozzle 4 to enter into the flow-through passage 5 and moves against the baffle body 7.

Further along, the flow passes through the annular local constriction 8. When flowing about the cone-shaped baffle body 7, a cavity is formed past the baffle body which, after having been separated, the cavity is disintegrated in the flow into a mass of cavitation bubbles having different characteristic dimensions. The resulting cavitation field, having a vortex structure, makes it possible for processing liquid components throughout the volume of the flow-through passage 5.

The hydrodynamic flow moves the bubbles to the increased pressure zone, where their coordinated collapsing occurs, accompanied by high local pressure (up to 1500 MPa) and temperature (up to 15,000° K), as well as by other physio-chemical effects which initiate the progress of mixing, emulsification, homogenization and dispersion.

After the flow of a mixture of liquid components is processed in the cavitation field, the qualitatively and quantitatively changed mixture of liquid components flow is then discharged from the device through the divergent nozzle 6 and the outlet opening 3.

FIG. 2 presents an alternative embodiment of the device for carrying into effect the herein-proposed method, according to the invention, characterized in that the baffle body 7 is shaped as the Venturi tube and fitted on the wall of the flow-through passage 5. The local flow constriction 8 is established at the center of the flow-through passage 5.

The hydrodynamic flow of liquid components flowing along the direction of the arrow A arrives at the flow-through passage 5 and is throttled while passing through the annular local constriction 8. The resultant hydrodynamic field is featured by its high intensity which is accounted for by the high flow velocity and pressure gradient. The stationary-type cavitation voids are relatively oblong-shaped, and, upon their disintegration, form rather large-sized cavitation bubbles which, when collapsing, possess high energy potential. This cavitation field provides for improved mixing, emulsification, homogenization and dispersion of a mixture of liquid components.

In order to control the intensity of the hydrodynamic cavitation field, the baffle body 7 placed in the flow-through passage 5 is shaped as a sphere, ellipsoid, disk, impeller as shown in FIGS. 3A–3D, respectively.

Figure 3A:
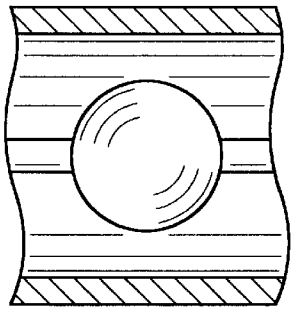
FIGS. 3A–3D is a fragmentary longitudinal section view of a flow-through passage of the device of FIG. 1, featuring the diversely shaped baffle body.
Figure 3B:
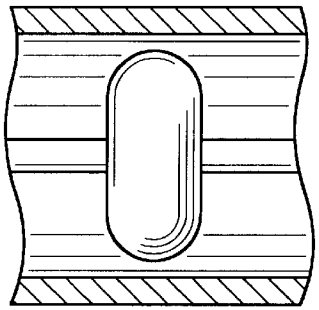
Figure 3C:
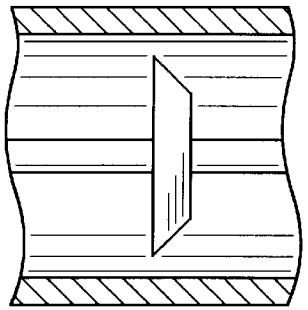
Figure 3D:
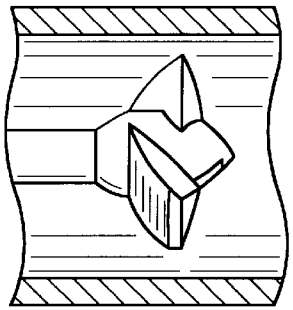
Figure 4A:
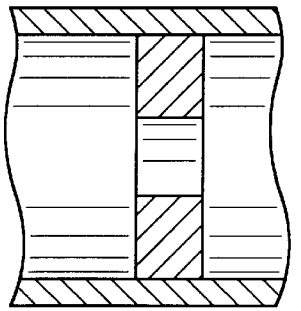
FIGS. 4A–4D is a fragmentary longitudinal section view of a flow-through passage of the device of FIG. 2, featuring a flow-throttling diversely shaped baffle body.
Figure 4B:
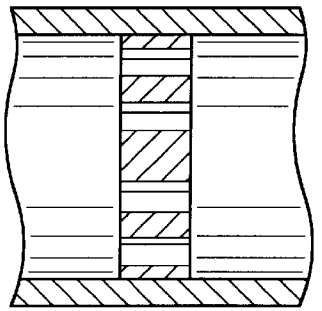
Figure 4C:
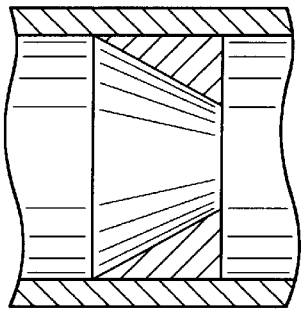
Figure 4D:
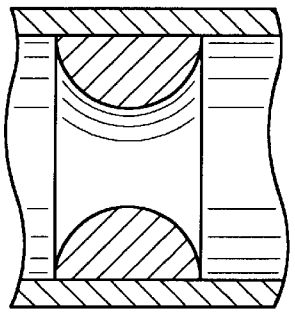

Moveable cavitation voids develop past the baffle body 7 shaped as a sphere or ellipsoid (FIGS. 3A, B). Cavitation bubbles, resulting from disintegrated voids and then collapsing in the increased pressure zone, exert a more "severe" effect on the mixture of liquid components under processing, because the energy potential of the resultant cavitation field is adequately high. This being the case, a considerable improvement occurs in the qualitative processing of liquid components.

The process of mixing, emulsification, homogenization and dispersion of liquid components in the cavitation field, developing past the disk-shaped baffle body 7 (FIG. 3C), proceeds as described with reference to the embodiment of FIG. 1. When the impeller-shaped baffle body 7 is used (FIG. 3D), the hydrodynamic flow is made to rotate, and a relatively larger amount of liquid components under processing are involved in the formed vortex cavitation field than in the case of the baffle bodies 7, described before.

When using the baffle body 7 shaped as a washer, perforated disk, or bushes having conical or toroidal internal wall surfaces as shown in FIGS. 4A–4D, respectively, the flow is throttled at the local flow constriction locations 8, which results in a local flow zone featuring high transverse velocity gradients. The baffle bodies 7 (FIGS. 4A, B, D) establish the constriction locations 8 at the center of the flow-through passage 5, while the disk- shaped baffle body 7 (FIG. 4B) establishes the constrictions arranged parallel to one another in the same cross-section of the passage 5.

The geometry of the baffle body 7 creates an accelerated flow of the mixture of liquid components, which promotes the development of a cavitation field having high energy potential due to the formation of the lower pressure zone within the local areas of high transverse velocity gradients around the sink flow streams. It is readily apparent that baffle body 7 may possess a variety of geometries to effect a high degree of mixing, emulsification, homogenization and dispersion of liquid components.

The hydrodynamic flow of a mixture of liquid components is fed to the device by a pump. Depending on a required result of the technological process, the flow may be fed through the device either once or repeatedly according to a recirculation pattern.

The desired quality of the obtained emulsion is evaluated by the volumetric mean diameter size of the disperse phase droplet or particle. The quality of emulsion is effected by variances in the constriction ratio, flow rate and the degree of cavitation.

Some specific examples of embodiments describing practical implementation of the method and carried out on pilot specimens of the device, according to the invention, as presented in FIGS. 1 and 2, are described as follow:

EXAMPLE 1

A hydrodynamic flow of a mixture, comprised of 98 mass % water and 2 mass % of vegetable oil, is fed at a velocity rate of 6 meters/second through inlet opening 2 in the device, as shown in FIG. 1. A static pressure at the inlet of the flow-through passage 5 is 0.43 MPa, and, at the outlet, 0.31 MPa. The ratio of the cross-sectional flow portion in the local constriction 8 to the cross-sectional flow portion of the flow-through passage 5 is 0.8. The flow velocity at the local constriction 8 is 14 meters/second. The flow of components passes along the flow-through passage 5 and flows in a conical shape in accordance with the cone-shaped baffle body 7. After the baffle body 7, a cavitation zone is created with a degree of cavitation of 0.1. The flow of processed components, flowing along the flow-through passage 5 and flowing along the cone-shaped baffle body 7, is subjected to the cavitation effect which initiates the progress of a high degree of emulsification. The quality of the obtained emulsion is evaluated by the volumetric mean diameter size of the disperse phase (oil) droplet or particle. In this example, the volumetric mean diameter size of the oil droplets is 22.4 microns.

EXAMPLE 2

A hydrodynamic flow of a mixture, comprised of 98 mass % water and 2 mass % of vegetable oil, is fed at a velocity rate of 6 meters/second through inlet opening 2 in the device, as shown in FIG. 1. A static pressure at the inlet of the flow-through passage 5 is 0.91 MPa, and, at the outlet, 0.35 MPa. The ratio of the cross-sectional flow portion in the local constriction 8 to the cross-sectional flow portion of the flow-through passage 5 is 0.31. The flow velocity at the local constriction 8 is 36.2 meters/second. The flow of components passes along the flow-through passage 5 and flows in a conical shape in accordance with the cone-shaped baffle body 7. After the baffle body 7, a cavitation zone is created with a degree of cavitation of 1.7. The flow of processed components, flowing along the flow-through passage 5 and flowing along the cone-shaped baffle body 7, is subjected to the cavitation effect which initiates the progress of a high degree of emulsification. The volumetric mean diameter size of the disperse phase (oil) droplet or particle of this example is 5.7 microns.

EXAMPLE 3

A hydrodynamic flow of a mixture, comprised of 98 mass % water and 2 mass % of vegetable oil, is fed at a velocity rate of 6 meters/second through inlet opening 2 in the device, as shown in FIG. 1. A static pressure at the inlet of the flow-through passage 5 is 7.95 MPa, and, at the outlet, 0.56 MPa. The ratio of the cross-sectional flow portion in the local constriction 8 to the cross-sectional flow portion of the flow-through passage 5 is 0.10. The flow velocity at the local constriction 8 is 112.5 meters/second. The flow of components passes along the flow-through passage 5 and flows in a conical shape in accordance with the cone-shaped baffle body 7. After the baffle body 7, a cavitation zone is created with a degree of cavitation of 4.2. The flow of processed components, flowing along the flow-through passage 5 and flowing along the cone-shaped baffle body 7, is subjected to the cavitation effect which initiates the progress of a high degree of emulsification. The volumetric mean diameter size of the disperse phase (oil) droplet or particle of this example is 2.8 microns.

EXAMPLE 4

A hydrodynamic flow of a mixture, comprised of 98 mass % vegetable oil and 2 mass % of water, is fed at a velocity rate of 5.7 meters/second through inlet opening 2 in the device, as shown in FIG. 2. A static pressure at the inlet of the flow-through passage 5 is 2.67 MPa, and, at the outlet, 0.42 MPa. The ratio of the cross-sectional flow portion in the local constriction 8 to the cross-sectional flow portion of the flow-through passage 5 is 0.2. The flow velocity at the local constriction 8 is 45.6 meters/second. The flow of components passes through the flow-through passage 5 and the internal flow constriction 8 created by the Venturi tube-shaped baffle body 7. After the baffle body 7, a cavitation zone is created with a degree of cavitation of 1.3. The flow of components through the cavitation zone are effected by producing a high degree of emulsification. The quality of the obtained emulsion is evaluated by the volumetric mean diameter size of the disperse phase (water) droplet or particle. It has a measurement of 6.2 microns.

While the invention has been described in connection with specific embodiments and applications, no intention to restrict the invention to the examples shown is contemplated. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed:

1. A method of obtaining a free disperse system in liquid, comprising:

the passage of a hydrodynamic flow of components through a flow channel internally accommodating a single baffle body providing a local constriction of the hydrodynamic flow;

the creation of a local constriction of the flow in a single section of the flow channel emanating from the condition of maintaining the ratio of the cross-sectional portion of the hydrodynamic flow in the local constriction to the cross-sectional portion of the flow in the flow channel to 0.8 or less;

maintaining the velocity of the hydrodynamic flow of components in the local constriction to at least 14 meters/second, providing for the development of a hydrodynamic cavitation field downstream from the baffle body having a degree of cavitation of at least 0.1;

processing the flow of components mixture in the hydrodynamic cavitation field, downstream from the baffle body.

2. A method according to claim 1, wherein the local flow constriction of the components mixture created on the periphery of the flow, its path accommodated by the baffle body, is established at or near to the center of the flow-through passage.

3. A method according to claim 1, wherein the local flow constriction of the components mixture created in or near the center of the flow, its path accommodated by the baffle body, is established near the walls of the flow-through passage.

4. A method for obtaining a free disperse system in liquid comprising the steps of:

establishing a hydrodynamic flow of first and second components through a housing comprising an inlet and an outlet communicating with the open ends of a channel having a first portion, the flow through the first portion having a first cross-sectional areas, A1;

directing the flow of the components through a second portion of the channel, the flow through the second portion having a second cross-sectional areas, A2, A2/A1 being between 0.5 and 0.8;

maintaining the flow of the components through the second portion at a velocity of at least 14 meters/second;

creating a hydrodynamic cavitation field in the channel downstream from the second portion;

passing the first and second components through the cavitation field; and discharging the flow of components through the outlet.

5. The method of claim 1 wherein the cavitation field has a degree of cavitation of at least 0.1.

6. The method of claim 4 wherein said housing further comprises a convergent nozzle disposed between the inlet and the channel and wherein the step of establishing a hydrodynamic flow further comprises passing the components through the convergent nozzle before passing the components through the channel.

7. The method of claim 4 wherein the housing further comprises a divergent nozzle disposed between the channel and the outlet, the method further comprising the step of passing the flow of components through the divergent nozzle before the step of discharging the flow of components through the outlet.

8. The method of claim 4 wherein the step of directing the flow of the components through the second portion of the channel comprises passing the components around a baffle body established at or near the center of the channel.

9. The method of claim 8 wherein the baffle body comprises a frustrum-conical shape.

10. The method of claim 8 wherein the baffle body comprises a spherical shape.

11. The method of claim 8 wherein the baffle body comprises an ellipsoid shape.

12. The method of claim 8 wherein the baffle body comprises an impeller.

13. The method of claim 8 wherein the step of directing the flow of the components through the second portion of the channel further comprises rotating the hydrodynamic flow around the baffle body.

14. The method of claim 4 wherein the step of directing the flow of the components through the second portion of the flow-through channel comprises passing the components around a baffle body established at or near a wall of the channel.

15. The method of claim 14 wherein the baffle body comprises a disc having a central opening therein, the disc being transverse to the flow.

16. The method of claim 14 wherein the baffle body comprises a disc having a plurality of openings therein, the disc being transverse to the flow.

17. The method of claim 14 wherein the baffle body comprises a bushing having a conical internal wall surface.

18. The method of claim 14 wherein the baffle body comprises a bushing having a toroidal internal wall surface.

19. A device for obtaining a free disperse system of liquid components in a hydrodynamic flow comprising:

a housing having a channel therein, an inlet for introducing the flow into the channel, and an outlet for discharging the flow from the channel, a first portion of the channel allowing passage of a first cross-sectional area, A1, of the flow therethrough, and a second portion of the channel allowing passage of a second cross-sectional area, A2, of the flow therethrough, A2/A1 being between 0.5 and 0.8; and, a single baffle body disposed within the second portion of the channel.

20. The device of claim 19 further comprising a hollow convergent nozzle disposed between the inlet and the channel.

21. The device of claim 19 further comprising a hollow divergent nozzle disposed between the channel and the outlet.

22. The device of claim 19 wherein the baffle body is located at or near the center of the channel.

23. The device of claim 22 wherein the baffle body comprises a frustum-conical shape.

24. The device of claim 22 wherein the baffle body comprises a spherical shape.

25. The device of claim 22 wherein the baffle body comprises an eliptoid shape.

26. The device of claim 22 wherein the baffle body comprises an impeller.

27. The device of claim 19 wherein the baffle body is located at or near a wall of the channel.

28. The device of claim 22 wherein the baffle body comprises a disc having a central opening therein, the disc being transverse to the flow.

29. The device of claim 22 wherein the baffle body comprises a disc having a plurality of openings therein, the disc being transverse to the flow.

30. The device of claim 22 wherein the baffle body comprises a bushing having a conical internal wall surface.

31. The device of claim 19 wherein the baffle body comprises a bushing having a toroidal internal wall surface.

32. A device for obtaining a free disperse system of liquid components in a hydrodynamic flow comprising:

a housing having a channel therein, an inlet for introducing the flow into the channel, an outlet for discharging the flow from the channel, a hollow convergent nozzle disposed between the inlet and the channel, and a hollow divergent nozzle disposed between the channel and the outlet, a first portion of the channel allowing passage of the first cross-sectional area, A1, of the flow therethrough, and a second portion of the channel allowing passage of a second cross-sectional area, A2, of the flow therethrough, A2/A1 being between 0.5 and 0.8; and, a single baffle body disposed within the second portion of the channel.

* * * * *

UNITED STATES PATENT AND TRADEMARK OFFICE

CERTIFICATE OF CORRECTION

PATENT NO : 5,810,052

DATED : September 22, 1998

INVENTOR(S) : Oleg Vyacheslavovich Kozyuk

It is certified that error appears in the above-identified patent and that said Letters Patent is hereby corrected as shown below:

On the title page, Item"[73] Assignee: Five Star Technologies Ltd., Cleveland, Ohio" should be deleted Signed and Sealed this Twenty-fifth Day of May, 1999

*Attest:*

Q. TODD DICKINSON

*Attesting Officer*

*Acting Commissioner of Patents and Trademarks*